US010581195B2

(12) United States Patent
Linseder

(10) Patent No.: US 10,581,195 B2
(45) Date of Patent: Mar. 3, 2020

(54) HIGH-TEMPERATURE-RESISTANT PLUG CONNECTOR FOR KNOCK SENSOR

(71) Applicant: Hirschmann Automotive GmbH, Rankweil/Brederis (AT)

(72) Inventor: Manuel Linseder, Rankweil (AT)

(73) Assignee: HIRSCHMANN AUTOMOTIVE GMBH, Rankweil/Brederia (AT)

( * ) Notice: Subject to any disclaimer, the term of this patent is extended or adjusted under 35 U.S.C. 154(b) by 0 days.

(21) Appl. No.: 16/307,013

(22) PCT Filed: Jul. 14, 2017

(86) PCT No.: PCT/EP2017/067910
§ 371 (c)(1),
(2) Date: Dec. 4, 2018

(87) PCT Pub. No.: WO2018/011415
PCT Pub. Date: Jan. 18, 2018

(65) Prior Publication Data

US 2019/0221963 A1 Jul. 18, 2019

(30) Foreign Application Priority Data

Jul. 15, 2016 (DE) ..... 10 2016 113 066

(51) Int. Cl.
*H01R 13/627* (2006.01)
*H01R 13/58* (2006.01)
(Continued)

(52) U.S. Cl.
CPC ..... *H01R 13/5829* (2013.01); *H01R 13/436* (2013.01); *H01R 13/4361* (2013.01);
(Continued)

(58) Field of Classification Search
CPC ..... H01R 13/5829; H01R 13/436; H01R 43/005; H01R 13/502; H01R 13/5202; H01R 13/5205; H01R 43/20
(Continued)

(56) References Cited

U.S. PATENT DOCUMENTS 4,708,662 A * 11/1987 Klein ..... H01R 13/6273 439/353
4,973,268 A * 11/1990 Smith ..... H01R 13/4365 439/589
(Continued)

FOREIGN PATENT DOCUMENTS

DE 202013000969 U 6/2014

*Primary Examiner* — Abdullah A Riyami
*Assistant Examiner* — Nelson R. Burgos-Guntin
(74) *Attorney, Agent, or Firm* — Andrew Wilford

(57) ABSTRACT

The invention relates to a method for mounting a plug connecter (1), comprising a contact carrier (30), which is designed to receive at least one contact partner (22) that is arranged on an electrical conductor (21) of a cable (20), wherein the contact carrier (30) is inserted in an outer housing (40). The invention is characterized in that the contact carrier (30) is provided with a latching lug (31) for fixing the at least one contact partner (22) in the contact carrier (30), and at least one latching hook (32) arranged at the end thereof and acting on the cable (20). Both the latching lug (31) and the at least one latching hook (32) are moved from an initial position into a functional position whenever the contact carrier (30) is inserted into the outer housing (40).

8 Claims, 4 Drawing Sheets

(51) Int. Cl.

| | |
|---|---|
| ***H01R 13/52*** | (2006.01) |
| ***H01R 13/436*** | (2006.01) |
| ***H01R 13/502*** | (2006.01) |
| ***H01R 43/00*** | (2006.01) |
| ***H01R 43/20*** | (2006.01) |

(52) U.S. Cl.
CPC ..... *H01R 13/502* (2013.01); *H01R 13/5202* (2013.01); *H01R 13/5205* (2013.01); *H01R 43/005* (2013.01); *H01R 43/20* (2013.01)

(58) Field of Classification Search
USPC ..... 439/460, 353, 580
See application file for complete search history.

(56) References Cited

U.S. PATENT DOCUMENTS 5,076,806 A 12/1991 Hotea
5,902,155 A * 5/1999 Polgar ..... H01R 13/518 439/353
6,116,938 A * 9/2000 Myer ..... H01R 13/6272 439/271
6,162,085 A * 12/2000 Chugh ..... H01R 13/5221 439/275
6,315,590 B1 * 11/2001 Grois ..... G02B 6/389 439/248
6,443,760 B2 * 9/2002 Hasegawa ..... H01R 13/641 439/352
6,786,755 B2 * 9/2004 Dambach ..... H01R 13/6273 439/353
7,748,717 B2 7/2010 Maerkle
2008/0026639 A1 * 1/2008 Sardi ..... H01M 2/20 439/607.41
2012/0202372 A1 * 8/2012 Hardy ..... H01R 9/0518 439/460
2013/0088106 A1 * 4/2013 Bitzer ..... H01R 13/5202 310/71
2013/0102185 A1 * 4/2013 Mulfinger ..... H01R 13/516 439/460
2013/0143448 A1 * 6/2013 Eckel ..... H01R 13/44 439/686
2013/0230996 A1 * 9/2013 Klein ..... H01R 13/533 439/271
2017/0149186 A1 * 5/2017 Vishwanath ..... H01R 13/6272
2018/0062305 A1 * 3/2018 Denz ..... H01R 4/2433
2019/0044275 A1 * 2/2019 Stenzel ..... G01M 3/2838

* cited by examiner

HIGH-TEMPERATURE-RESISTANT PLUG CONNECTOR FOR KNOCK SENSOR

CROSS REFERENCE TO RELATED APPLICATIONS

This application is the US-national stage of PCT application PCT/EP2017/067910 filed 14 Jul. 2017 and claiming the priority of German patent application 102016113066.4 itself filed 15 Jul. 2016.

FIELD OF THE INVENTION

The invention relates to a plug connector and to a method of assembling a plug connection.

BACKGROUND OF THE INVENTION

Plug connectors are known that comprise a contact support having a number of contact chambers that corresponds to the number of contacts that these contact chambers are to receive, each contact being mounted on one end of an electrical conductor of a cable, in other words each contact is mechanically fixed and electrically contacted at this end. In the simplest case, the contact support comprises a contact chamber that receives only one contact. In practice, plug connectors are also already known that comprise a contact support that comprises more than one contact chamber in a row, where appropriate however also in multiple rows that lie parallel with one another.

During the procedure of assembling such plug connectors, the contact is mounted in an appropriate manner at the end of the respective electrical conductor of the cable and subsequently inserted into the contact chamber in the contact support. In order for the contact to be fixed in its contact chamber, the contacts comprise in a known manner a flexible protruding spring lug. This spring lug is moved out of its starting position as the contact is pushed into the contact chamber until the contact is in the contact chamber. Once this contact has achieved its final position, the spring lug moves back into its starting position and as a result latches with a corresponding undercut on the contact support of the plug connector. For this purpose, it is necessary to equip such contacts with these spring lugs, as a result of which such contacts have a complex shape and are consequently complex to produce. Moreover, it is necessary during the assembly procedure to take care that, after the contact has been inserted into its contact chamber, the spring lug also latches in the proper manner with the undercut. It is often not possible for this to occur if the contact is not fully inserted and in the intended orientation in its respective contact chamber.

Furthermore, it is also already known that the contact support is provided with an outer housing after the contact is in its respective contact chamber. There are fundamentally two possibilities for this. On the one hand, the outer housing may be achieved using an injection molding method. However, this requires complex measures that on the one hand prevent the injection molding mass from passing into the contact chamber and into the seat of the plug connector for a mating plug connector. Moreover, in order to achieve the longitudinal water tightness that is frequently required, it is absolutely necessary that the tolerances during the injection molding procedure and the materials used for the outer sheath of the cable and the injection molding mass to be coordinated with one another in an optimal manner so as to form the outer housing. If this is achieved, the connection between the injection molding mass, which forms the outer housing, and the contact support and also the outer sheath of the cable produces a sufficiently leak-tight connection, and the injection-molded outer housing also provides the likewise frequently required strain relief.

However, there are applications where such plug connectors are used in a high temperature environment. The term 'high temperature' is understood to mean all temperatures that are clearly above the ambient temperature and to which a vehicle is by way of example exposed. Such temperatures are not only temperatures that arise as a result of external heat rays (sun rays) but also temperatures that prevail at the installation site of the plug connector (such as for example in the engine bay or transmission housing, in the region of the axles or in other installation spaces in which temperatures rise). Moreover, there is always the problem in such installation spaces that the plug connection, which is formed from the plug connector and a mating plug connector, is exposed to water, spray water, moisture and the like.

In order to be able to counteract the high temperatures, it is already known to produce the casing line (outer sheath) of the cable from a high temperature-resistant material. Whereas such an outer sheath has exceptionally high resistance characteristics (water tightness, heat resistance and the like) at the installation site, there is however the problem that in such a case it is not possible to form the outer housing using an injection molding procedure. The reason for this is that during the injection molding procedure the material that forms the injection molding mass is brought up to higher temperatures so that it melts and may be accordingly injection molded. However, during the injection molding procedure this temperature does not cause the material of the outer sheath of the cable to dissolve since the precise purpose of this outer sheath is to withstand high temperatures. As a consequence, it is not possible to achieve a united connection between the injection molding mass and the high temperature-resistant outer sheath of the cable. The consequences of this are that it is not possible to achieve longitudinal water tightness or also a strain relief. This problem does not arise by way of example if the outer sheath of the cable is made of a material that is not resistant to high temperatures, such as by way of example polyurethane (PUR).

OBJECT OF THE INVENTION

The object of the invention is therefore to provide both a plug connector and also a method of assembling such a plug connector with which it is possible to avoid the disadvantages mentioned in the introduction. In particular, it is to be ensured that whilst being comparatively simple to assemble cables that comprise an outer sheath made of a high temperature-resistant material also have the longitudinal water tightness and the strain relief. Moreover, in particular a concept of a water-tight plug connector having a high temperature-resistant casing line (outer sheath of the cable) is to be provided so as on the one hand to achieve tightness between the injection molding and the outer sheath and on the other hand to provide a strain relief in order to provide a different solution, since materials of the casing line that are made of materials that are stable when subjected to high temperatures do not allow the outer housing to be injection molded in a firmly bonded manner.

SUMMARY OF THE INVENTION

The object is achieved in that the contact support comprises a latch lug for fixing the at least one contact in the contract support and at least one latch hook that is mounted on its end and acts on the cable.

It is possible for the latch lug to fix the at least one contact, preferably multiple contacts in one step in the contact support. It is possible to forego the complex design of contacts that have protruding flexible spring lugs for providing the so-called primary locking arrangement of the contact in the contact support, with the result that the contacts may be designed in a simpler manner. Whereas in the case of contacts that have protruding spring lugs for the purpose of providing the primary locking arrangement, it was not possible to check whether the primary locking procedure has also actually been performed in the proper manner after the contact has been inserted into its contact chamber, this checking possibility is provided via the latch lug on the contact support. If namely only the single contact or at least one of multiple contacts is not inserted in the proper manner into its contact chamber in the contact support, it is not possible to actuate the latch lug for the primary locking arrangement. As a result, it is possible to perform a mechanical, where appropriate also optical, checking procedure as to whether the primary locking arrangement has been performed. This checking procedure may also be performed in an automated manner.

In cooperation with this latch lug on the contact support for producing the primary locking arrangement of the contacts in their contact chambers in the contact support, the contact support comprises at least one latch hook that is mounted on its end (the end lying opposite the seat for the mating plug connector) and acts on the cable. The at least one latch hook, preferably two latch hooks that lie opposite one another according to a further development of the invention, act on the outer sheath of the cable in such a manner that a pressure is exerted by the outer housing on the at least one latch hook if the contact support is into the outer housing in the intended manner to make a positive-locking connection between the latch hook and the outer sheath, in order thus to achieve both the longitudinal water tightness and also the strain relief. In other words, according to the invention it is no longer necessary to provide a bonded connection between the outer housing and the outer sheath of the cable but rather the longitudinal water tightness and the strain relief is achieved with a positive-locking connection by the at least one latch hook with the outer sheath of the cable. It is of particular advantage if the internal geometry of the at least one latch hook, preference of the two latch hooks, is designed in such a manner that the outer sheath may still be moved in this region as the cable is inserted. However, following the effect of the pressure on the at least one latch hook by the outer housing, the latch hook is to exert such a pressure on the outer sheath of the cable that the required positive-locking connection is achieved by matching the geometries.

In a further embodiment of the invention, the contact support is formed with a circumferential groove into which a housing seal is fitted. Since the contact support and the outer housing that surrounds this contact support are separate components, it is absolutely necessary to provide a seal in order to achieve the longitudinal water tightness from the direction of the cable in the direction of the mating plug connection. For the purpose of a simplified assembly procedure, this housing seal between the contact support and the outer housing is inserted as a separate part into a circumferential groove in the contact support. As a consequence, it is possible to produce the contact support in a very simple manner by way of example as an injection molded part and also to insert the housing seal in a very simple manner into the circumferential groove. Moreover, it is possible to perform in particular a further optical check as to whether the housing seal is inside the circumferential groove.

As an alternative or in addition to the above mentioned solution, it is also conceivable to provide a seal in the sealing region between the contact support and the outer housing, this seal being a component of the outer housing and/or of the contact support. It is possible for this purpose by way of example to consider producing the contact support and/or the outer housing with a seal that faces outward (contact support) or with a seal that faces inward (outer housing) using a two-component synthetic material injection molding method. The geometry of such a seal (either only on the contact support or only on the outer housing) or the geometries of the two seals (both on the outer housing and also on the contact support) are tailored to suit one another with the result that the at least one seal on the outer housing or on the contact support comes to lie against the respective component. Moreover, it is conceivable that when using two seals (both on the contact support and also on the outer housing) the two seal geometries come to lie against one another.

In a further embodiment of the invention, the outer housing comprises on its end a seat into which a cable seal that forms a seal on the cable is fitted. It is also expedient in this case in order to achieve the required longitudinal water tightness if a sealing arrangement is provided between the outer sheath of the cable and the outer housing. In order to achieve a simple assembly procedure for achieving this sealing effect, a seat is provided on the end of the outer housing (on the end that is remote from the seat for the mating plug connector), wherein the cable seal is already inserted prior to the plug connector being assembled with its individual components or this cable seal is inserted during the assembly procedure.

Also with regard to the cable seal, it is as an alternative, as also described above with regard to the design of the housing seal, conceivable that the outer housing comprises on its end a unitary cable seal that forms a seal on the cable. Also in such a case, the outer housing is produced using a two-component synthetic-resin injection-molding procedure, wherein the one material of a synthetic material is a harder material in order to form the housing per se, and the material that forms the cable seal is accordingly softer so as to achieve the sealing effect. With regard to the assembly procedure, this embodiment has the particular advantage that it is possible to assemble one part less (namely a separate cable seal), as a result of which, compared with the design of the cable seal as a separate component, it is not only possible to not to forget one part but rather also one assembly step less is required.

In a further embodiment of the invention, the cable comprises an outer sheath that is made of a high temperature-resistant material. Whereas normal ambient conditions are defined as a reference temperature, in particular in the case of vehicles, for example in a range between −20° and +50°, high temperatures are considerably higher, in particular higher than the mentioned 50°. High temperatures are in particular higher than 75°, further in particular higher than 100°, further in particular higher than 120° and further higher than 150°.

With regard to the method of assembling the plug connector, it is provided in accordance with the invention, that the contact support comprises a latch hook for fixing the at least one contact in the contact support and at least one latch hook that is mounted on its end and acts on the cable, wherein both the latch lug and also the at least one latch hook are moved from a starting position into a functioning position if the contact support is into the outer housing. As a consequence, the advantage is provided that the contact support comprises the means, as already described above with regard to the plug connector itself, for achieving the primary locking arrangement of the at least one contact in its contact chamber in the contact support and also for achieving the longitudinal water tightness and also the strain relief. This is performed in one assembly step, namely if the contact support is inside the outer housing, after this contact support has been provided with the further components, such as contacts, cable and where appropriate further elements, this further components being required so as to achieve the function of the plug connector. With regard to the starting position of the latch lug on the contact support, this is regarded as being a protruding position in which it is possible to insert each contact into its respective contact chamber in the contact support. Only after the entire number of contacts has been inserted into the respective contact chamber, is this latch lug on the contact support moved from the starting position into the functioning position as a result of the influence of the outer housing. This functioning position ensures that the primary locking arrangement of the contacts that are inserted into the contact chamber is performed by the latch lug.

Whereas with regard to the plug connector itself and also with regard to the method, the description relates to one latch lug that is mounted on the contact support, it is also conceivable to combine multiple contacts for a primary locking arrangement with the result that it is not necessary for all contacts to be primarily locked by a single latch lug but rather a specific number of contacts may be primarily locked with a first latch lug, whereas further contacts may be primarily locked by at least one further latch lug (where appropriate also more than two latch lugs). This is a particular consideration if for example two rows of contacts are mounted in each case in one row and one latch lug is provided for each row on the contact support.

In a further embodiment of the invention, the outer housing comprises on its end a seat into which a cable seal that in its functioning position forms a seal on the cable is moved into the seat by inserting the contact support into the outer housing. As a consequence, not only is the assembly procedure simplified because the cable seal is moved simultaneously as the contact support is into the outer housing but rather also the longitudinal water tightness is achieved. This step is omitted in any case if the cable seal is not configured as a separate component but rather is configured as one piece with the outer housing as already explained with regard to the plug connector.

It is preferred that the plug connector is used in vehicles, for example in an engine bay (for example for cabling actuators, such as injection valves or sensors, such as rotational speed sensors, knock sensors and the like) or on a transmission (likewise for cabling actuators and/or sensors) or in other installation spaces in vehicles in which high temperatures prevail that are considerably higher (in particular higher than 75° C.) than the ambient temperature (in particular approximately up to 50° C.).

BRIEF DESCRIPTION OF THE DRAWING

The method relating to the assembly procedure according to the invention and also two similar embodiments are described and explained below with reference to the figures.

SPECIFIC DESCRIPTION OF THE INVENTION

Both variants are based on a plug connector 1 that is to be produced and then installed in a high temperature region, in particular in an automotive environment. The plug connector 1 forms together with a mating plug connector (not shown) a plug connection, and the mating plug connector may be likewise mounted as the plug connector 1 itself on an end of a cable but may also be a component of an electronic device, for example of a control device in a vehicle.

Figure 1:
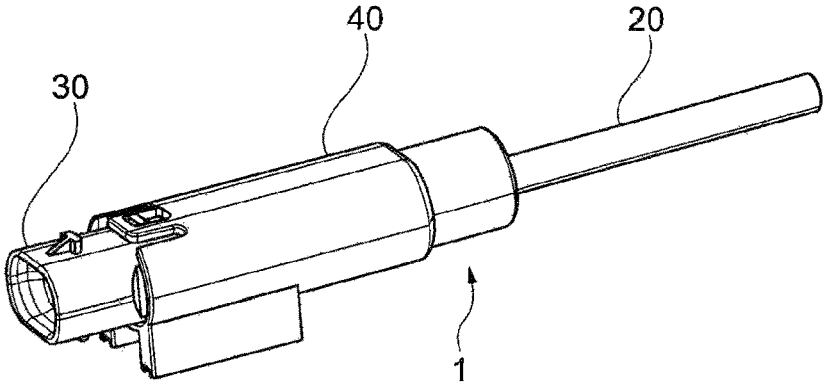
FIGS. 1 to 4 show a first embodiment of the invention.

The plug connector 1 shown in FIG. 1 is mounted on an end of a cable 20 and comprises a contact support 30, and the end of the cable 20 and also the major part of the contact support 30 are fixed inside an outer housing 40. The contact support 30 and also the outer housing 40 are components that are produced separately from one another and may be produced by way of example from identical or different materials, preferably in high numbers, using a synthetic-resin injection-molding procedure.

It is important and a starting point for the entire invention, not only with regard to the embodiments, that the outer sheath of the cable 20 is made of a high temperature-resistant material that cannot be injection molded using a synthetic-resin injection-molding procedure with a corresponding injection molding mass to make it longitudinally water-tight and provide strain relief.

Figure 2:
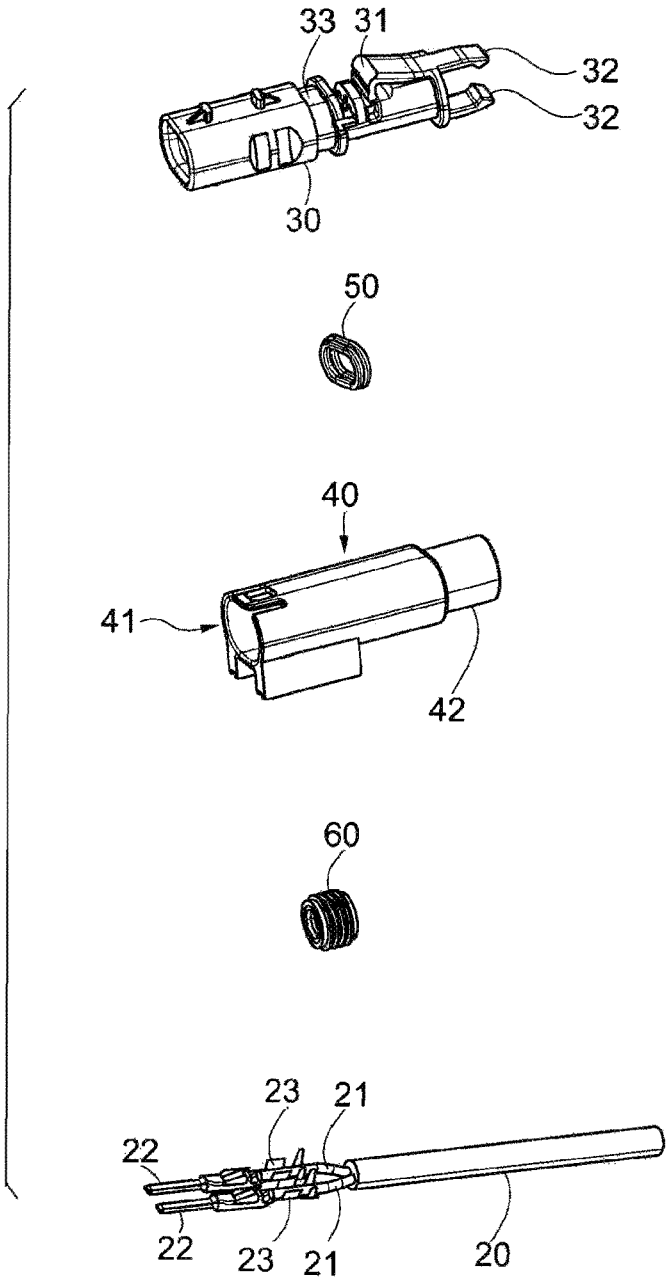

FIG. 2 shows different views of those elements that are combined to form the plug connector 1.

The illustration bottom right shows the cable 20 that comprises at least one electrical conductor 21, in this case precisely two electrical conductors 21. A number of contacts 22 that corresponds to the number of electrical conductors 21 of the cable 20 are mounted on the ends of the electrical conductors 21.

The contacts 22 in this embodiment are pin contacts. Each contact 22 may be but does not have to be mounted on its respective electrical conductor 21 via a crimp connection 23. A crimp connection 23 provides the particular advantage that in this manner it is possible both to electrical contact and also mechanically fix the contact 22 to its electrical conductor 21 in a reliable, permanent and also where appropriate automated manner.

The illustration top left in FIG. 2 shows the contact support 30 that comprises at least one latch lug 31. Moreover, the contact support 30 comprises on its one end at least one latch hook 32, in this case two diametrally opposite latch hooks 32. Moreover, this contact support 30 is formed with a circumferential groove 33.

FIG. 2 shows the outer housing 40 that comprises a seat 41 for a mating plug connector (not shown). A seat 42 for receiving a cable seal (still to be described) is provided on the end of the outer housing 40 lying opposite the seat 41.

The upper middle illustration shows a housing seal 50 and a cable seal 60 is apparent in the lower left illustration in FIG. 2.

In particular the geometric design of the housing seal 50 and of the cable seal 60 is only exemplary and may be modified, in other words adjusted each depending upon the shape of the contact support 30 or of the outer housing 40.

Figure 3:
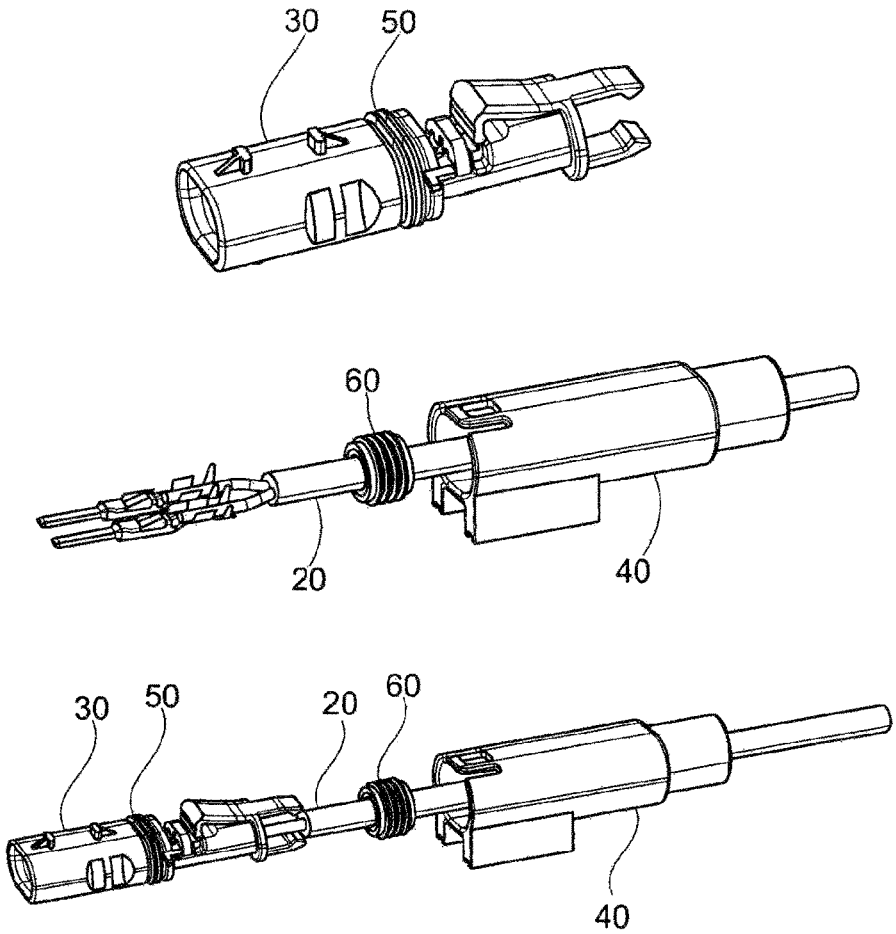

FIG. 3 shows the steps for assembling the plug connector 1, the elements shown in FIG. 2 being used.

It is apparent in the upper left illustration that in a first step the housing seal 50 is fitted into the circumferential groove 33. This may be done by hand or in an automated manner, wherein this design has the advantage that it is possible to visually check as to whether the housing seal 50 has been inserted into the groove 33 or not.

In a second step, the prepared cable 20 (apparent in the lower right illustration in FIG. 2) is pushed starting from the seat 42 of the outer housing 40 forward with the contacts 22 through this outer housing. It is also conceivable depending upon the design of the entire cable to push the end of the cable 2 that is remote from the contacts 22 from the seat 41 into the outer housing 40.

Moreover, it is apparent in the upper right illustration in FIG. 3 that the correspondingly prepared end of the cable 20 is provided with the cable seal 60.

After this preparation, the contact support 30 is fitted into the outer housing 40. In other words, when viewing the lower illustration in FIG. 3, the contact support 30 is inserted toward the right into the outer housing 40. As the contact support 30 moves longitudinally in the direction of the interior of the outer housing 40, the cable seal 60 moves from its fixed position on the cable 20 in the direction of the seat 42 of the outer housing 40 and is fixed there. As an alternative thereto, it is also conceivable, prior to pushing in the cable 20, to insert the cable seal 60 in advance into the seat 42 of the outer housing 40. The variant shown in FIG. 3 (bottom) does however have the advantage that by fixing the cable seal 60 to the cable 20 in advance it is possible to ascertain that the cable seal 60 is in place and may be moved into its intended position. This also renders it possible on the other hand to visually check that this cable seal 60 is not forgotten.

If the contact support is moved further in the direction of the interior of the outer housing 40, not only the cable seal 60 fixed in the intended manner in the seat 42 but rather the at least one latch hook 32, in particular the two diametrally opposite latch hooks 32, come to lie against the internal surfaces of the outer housing 40. In this case, this internal geometry is selected in such a manner (for example with an oblique extension) that the internal geometry presses on the outer surface of the at least one latch hook 32, which in turn ensures that the contacting surfaces of the latch hook 32 act in a positive-locking manner on the outer sheath of the cable 20, in particular is pressed against this outer sheath. As a result, this positive-locking arrangement produces the longitudinal water tightness in this region and also the strain relief.

When the contact support 30 is in the outer housing 40, not only the two latch hooks 32 are actuated in this embodiment but rather also the at least one latch lug 31 is actuated (or in the case that multiple latch lugs are provided all latch hooks are actuated). This means that the internal surfaces of the outer housing 40 act on the latch hook 31, which is initially in an oblique position, and moves this latch hook 31 out of its starting position into its functioning position in order to primarily lock the contacts 22 that are inserted into the contact chambers of the contact support 30. This primary locking arrangement does not function if even only one of the contacts 22 is not located in its desired position in its contact chamber of the contact support 30. As a consequence, in addition to achieving the longitudinal water tightness and the strain relief, it is not only possible to achieve the primary locking arrangement in one assembly step but rather it is also possible to perform a check as to whether the contacts 22 are mounted in the intended manner in their contact chambers.

Figure 4:
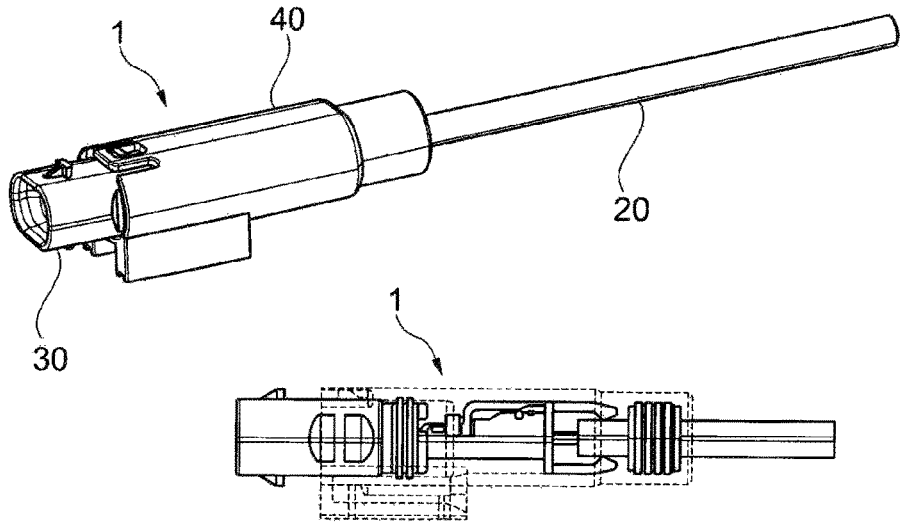
Figure 5:
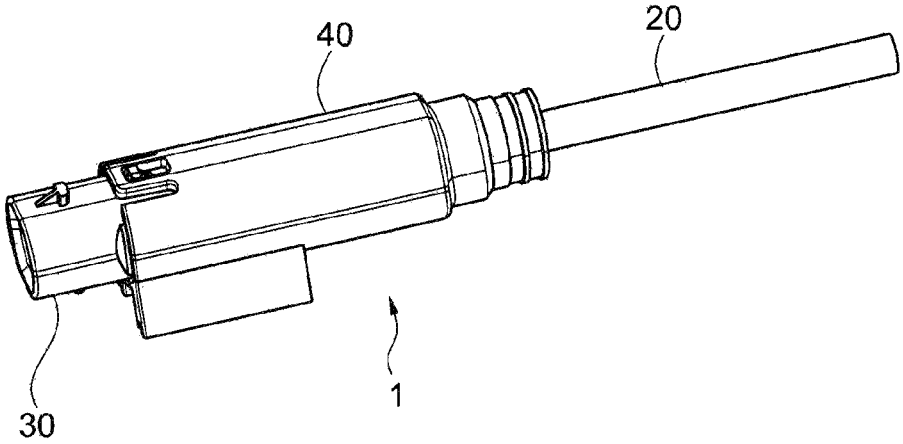
FIGS. 5 to 8 show a second embodiment.
Figure 6:
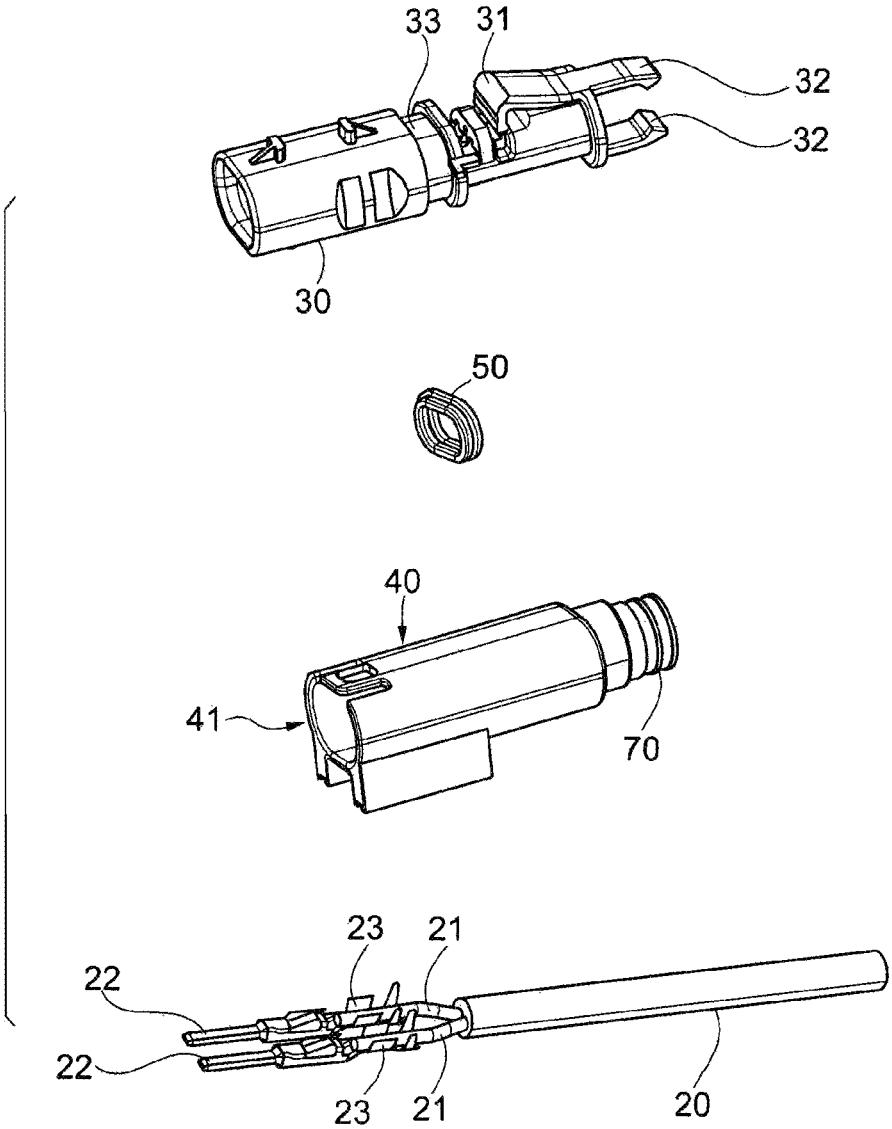
Figure 7:
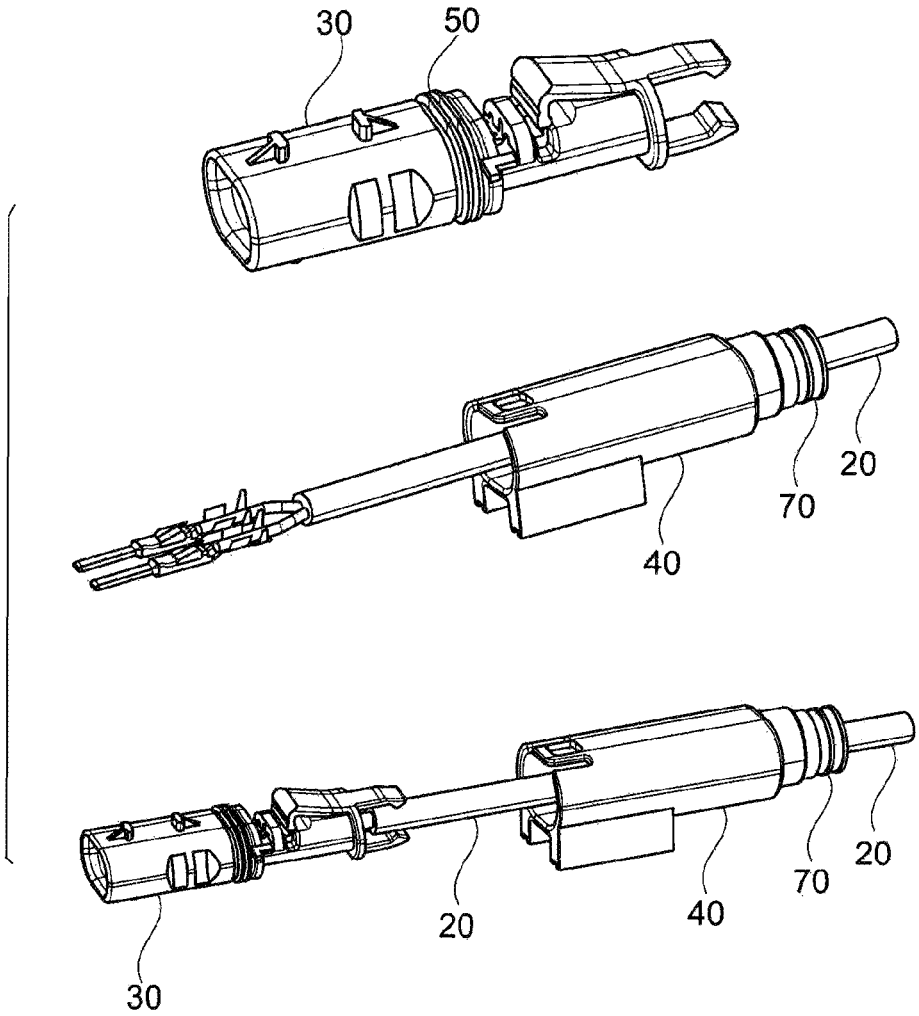
Figure 8:
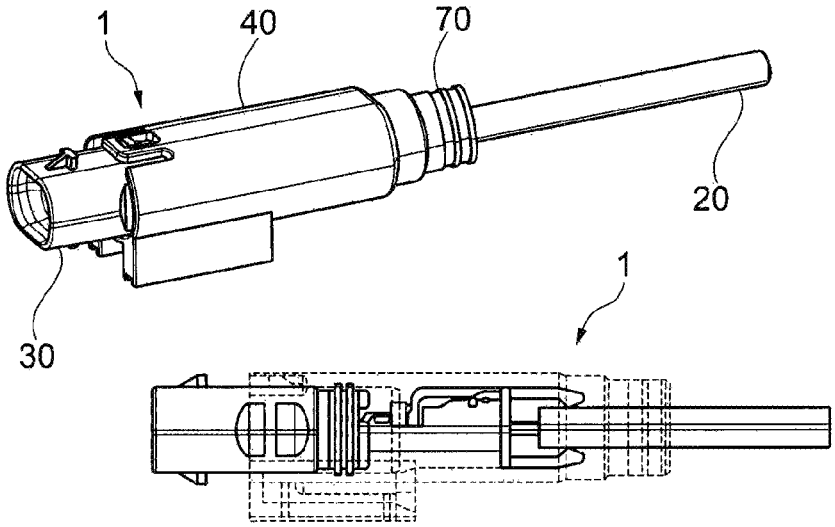

The above described procedure may be viewed in FIG. 4 that shows

- the cable seal 60 is mounted in the intended manner in its seat 42 of the outer housing 40,
- the two latch hooks 32 have been moved from their starting position into their functioning position in order for a positive-locking connection (press-fit connection) to produce the longitudinal water tightness in this region and also the strain relief,
- the at least one latch lug 31 has been moved into its intended functioning position in order to provide the primary locking arrangement of the contacts, and
- the housing seal 50 produces the longitudinal water tightness between the contact support 30 and the outer housing 40.

Finally, it is still necessary to reliably and permanently fix the contact support 30 in its intended position within the outer housing 40. It is possible to perform this with a latching connection (as shown in FIGS. 1 and 4). It is also possible as an alternative or in addition thereto to provide further latching connections that are to produce the connection with an adhesive procedure or to fix the contact support 30 with a press-fit connection inside the outer housing 40.

The second embodiment that is shown in FIGS. 5 to 8 is fundamentally based on the elements and the assembly sequence that is shown in FIGS. 1 to 4 and described in this regard.

The only difference resides in the fact that the outer housing 40 comprises a cable seal 70 at its end. This cable seal 70 is produced during the production of the outer housing 40, for example using a two-component synthetic-resin injection-molding procedure. If the outer housing 40 and the cable seal 70 are a one-piece component, it is possible to omit the separate cable seal 60 that would otherwise be necessary in the case of the embodiment in accordance with FIGS. 1 to 4. This has the particular advantage that one less separate component is required and one less separate component needs to be assembled.

In other respects, the plug connector 1 is assembled in accordance with the second embodiment in a precise manner as shown and described with regard to the first embodiment.

Both in the case of the first embodiment and also in the case of the second embodiment, it is then possible to likewise omit the housing seal 50 that is shown in this embodiments if this seal is likewise produced as one piece with the contact support 30 likewise using a two-component synthetic material injection molding method.

The invention claimed is:

1. A plug connector comprising:

a contact support configured for holding at least one contact mounted on an electrical conductor of a cable;

an outer housing fittable over and containing the contact support and having an inner surface;

a latch lug movable on the contact support between an outer starting position spaced from the contact and an inner position engaging and fixing the contact in the contact support; and a latch hook mounted on an end of the latch lug and movable between an outer starting position spaced from the cable and an inner position bearing on and fixing the cable in the contact support, the surface bearing on the hook and lug and pressing same into the inner positions when the contact support is fitted in the outer housing.

2. The plug connector according to claim 1, wherein the contact support is formed with a circumferential groove in which a housing seal is fitted.

3. The plug connector according to claim 1, wherein the outer housing comprises at its end a seat into which a cable seal that forms a seal on the cable is fitted.

4. The plug connector according to claim 1, wherein the outer housing comprises on its end a unitary cable seal that forms a seal on the cable.

5. The plug connector according to claim 1, wherein the contact support comprises at its end two diametrally opposite latch hooks that act on the cable.

6. The plug connector according to claim 1, wherein the cable comprises an outer sheath made of a high temperature-resistant material.

7. A method of assembling a plug connector, comprising a contact support that is configured for receiving at least one contact that is mounted on an electrical conductor of a cable and the contact support is inside an outer housing having an inner surface, the method comprising the steps of:

providing the contact support with a latch lug for fixing the at least one contact in the contact support and with a latch hook that is mounted on an end of the latch lug and acts on the cable; and moving both the latch lug and also the at least one latch hook from a starting position out of the engagement with the cable and with the contact by engagement with the inner surface of the outer housing into a functioning position bearing on the cable and contact and fixing same in the contact support when the contact support is inside the outer housing.

8. The method of assembling a plug connector according to claim 7, wherein the outer housing comprises on its end a seat into which a cable seal that in its functioning position forms a seal on the cable is moved into the seat by inserting the contact support into the outer housing.

* * * * *